United States Patent [19]

Kawai

[11] Patent Number: 4,914,012

[45] Date of Patent: Apr. 3, 1990

[54] SILVER HALIDE PHOTOGRAPHIC LIGHT-SENSITIVE MATERIAL

[75] Inventor: Masayoshi Kawai, Shizuoka, Japan

[73] Assignee: Fuji Photo Film Co., Ltd., Kanagawa, Japan

[21] Appl. No.: 291,023

[22] Filed: Dec. 28, 1988

[30] Foreign Application Priority Data

Dec. 28, 1987 [JP] Japan ..... 62-335570

[51] Int. Cl.[4] ..... G03C 1/76

[52] U.S. Cl. ..... 430/536; 430/523; 430/537; 430/631; 430/961

[58] Field of Search ..... 430/523, 536, 537, 627, 430/631, 961

[56] References Cited

U.S. PATENT DOCUMENTS

| | | | |
|---|---|---|---|
| 3,856,527 | 12/1974 | Hamb et al. | 430/961 |
| 4,232,117 | 11/1980 | Naoi et al. | 430/523 |
| 4,363,871 | 12/1982 | Shibue et al. | 430/961 |
| 4,499,179 | 2/1985 | Ota et al. | 430/523 |
| 4,542,088 | 9/1985 | Kojima et al. | 430/523 |
| 4,777,113 | 10/1988 | Inoue et al. | 439/961 |

*Primary Examiner*—Hoa Van Le

*Attorney, Agent, or Firm*—Sughrue, Mion, Zinn, Macpeak & Seas

[57] ABSTRACT

A silver halide photographic light-sensitive material having excellent scratch resistance is disclosed. The photographic light-sensitive material comprises a support having thereon at least two hydrophilic colloid layers, wherein at least one of the layers is a photosensitive silver halide emulsion layer, and at least one of the layers contains composite latex comprising polymeric acrylic acid ester and/or polymeric methacrylic acid ester, and colloidal silica.

8 Claims, No Drawings

SILVER HALIDE PHOTOGRAPHIC LIGHT-SENSITIVE MATERIAL

FIELD OF THE INVENTION

The present invention relates to a silver halide photographic light-sensitive material (hereinafter, referred to as "a photographic light-sensitive material"), and more particularly to a photographic light-sensitive material having excellent scratch resistance.

BACKGROUND OF THE INVENTION

A photographic light-sensitive material generally comprises a support, e.g., glass, paper, plastic film or paper coated with plastics, having provided thereon a photographic light-sensitive emulsion layer or layers, and any other desired layer or layers, e.g., an intermediate layer, a protective layer, a backing layer, an antihalation layer, and an antistatic layer. The photographic light-sensitive material is often adversely affected by contact friction in the process of production during coating, drying and processing steps and further in the handling, e.g., winding and rewinding, in shooting, development, printing, projection, etc., or conveying, more specifically by contact friction at areas where the light-sensitive material is in contact with various devices, machines, cameras, etc., or with attached materials, e.g., dust, fiber dust, etc., or by contact friction between photographic light-sensitive materials, e.g., between the front surface of the light-sensitive material and the back surface. For example, the front surface or back surface of the light-sensitive material is scratched, or driving properties of the light-sensitive material in the camera and so on are reduced, or film dust is produced in the camera and so on.

If such scratches are formed in the photographic light-sensitive material, blackening, sensitization or desensitization are undesirably produced at the scratched areas.

Thus a light-sensitive material which is less subject to such sensitization, desensitization and blackening scratches (hereinafter, referred to as a "light-sensitive material having good scratch resistance") has been desired.

Various methods have been proposed to obtain a photographic light-sensitive material having good scratch resistance. For example, a method in which the thickness of the protective layer of the photographic light-sensitive material is increased, a method in which a latex of acrylic acid ester, etc. is added to a binder of the protective layer as described, for example, in U.S. Pat. Nos. 3,508,925, 3,512,985, 3,533,793, 3,647,459, 2,772,166, 3,287,289, 2,376,005, 3,220,844 and 3,397,988, and a method in which colloidal silica is added to the binder of the protective layer as described, for example, in U.S. Pat. No. 3,053,662, are known.

If, however, the thickness of the protective layer of the light-sensitive material is increased, the rate of development is decreased at the step of development or fixing, resulting in a reduction of sensitivity and contrast, or a reduction of a rate of fixation.

If the latex is added to the binder of the protective layer, scratch resistance in handling at high humidity (relative humidity, at least 75%) is reduced although scratch resistance at low humidity (relatively humidity, not more than 45%) is improved.

On the contrary, if colloidal silica is added to the binder of the protective layer, scratch resistance at low humidity is not improved although scratch resistance at high humidity is improved.

SUMMARY OF THE INVENTION

The present invention is intended to overcome the above problems and an object of the present invention is to provide a photographic light-sensitive material which is free from a reduction of sensitivity and contrast, and is improved in scratch resistance at any humidity.

It has been found that the object is attained by adding a composite latex containing a polymeric acrylic acid ester and/or a polymeric methacrylic acid ester and colloidal silica to a hydrophilic colloidal layer.

The present invention relates to a photographic light-sensitive material comprising a support and at least two hydrophilic colloidal layers on at least one side of the support, wherein at least one of the colloidal layers is a photographic light-sensitive silver halide emulsion layer, and wherein a composite polymer latex containing at least one of polymeric acrylic acid ester and polymeric methacrylic acid ester and further containing colloidal silica in the polymer is present in at least one of these hydrophilic colloidal layers.

DETAILED DESCRIPTION OF THE INVENTION

The composite latex to be used in the present invention will hereinafter be explained.

The composite latex to be used in the present invention is characterized in that polymeric acrylic acid ester or polymeric methacrylic acid ester and colloidal silica are present in the form o an admixture in individual particles, i.e., as a composite. Thus, each particle in the latex contains a mixture of polymeric acrylic acid ester or polymeric methacrylic acid ester with colloidal silica. The colloidal silica is preferably present in the particles in an amount of from 5 to 400% by weight based on the weight of polymeric acrylic acid ester or polymeric methacrylic acid ester in the composite latex particles.

The average particle diameter of the composite latex particles is 0.01 to 0.5 $\mu$ and preferably 0.02 to 0.3 $\mu$.

The amount of the composite latex used is 0.03 to 10 $g/m^2$ and preferably 0.1 to 3 $g/m^2$.

Examples of the polymeric acrylic acid ester and polymeric methacrylic acid ester forming the composite latex include polymeric acrylic acid alkyl ester and polymeric methacrylic acid alkyl ester.

Specific examples include polymers of methyl acrylate, ethyl acrylate, butyl acrylate, methyl methacrylate, ethyl methacrylate and propyl methacrylate.

The composite latex to be used in the present invention is commercially available. For example, VONCOAT DV series (trade name, produced by Dai-Nippon Ink Co., Ltd.) can be used.

Of these commercially available composite latexes, all of products such as DV-823, DV-767, DV-759 and DV-772, in which the ratio of colloidal silica to polymeric acrylic acid ester and/or polymeric methacrylic acid ester is 30% by weight; DV-876, DV-857 and DV-1113 in which the ratio of colloidal silica to polymeric acrylic acid ester or polymeric methacrylic acid ester is 50% by weight; DV-940 and DV-804 in which the ratio of colloidal silica to polymeric acrylic acid ester or polymeric methacrylic acid ester is 100% by weight; and DV-803 in which the ratio of colloidal silica to polymeric acrylic acid ester or polymeric acid ester is 200% by weight can be preferably used in the present invention.

The photographic light-sensitive material of the present invention comprises a support having at least two hydrophillic colloid layers on the same side, at least one of which is a silver halide emulsion layer, and at least one of which is a surface protective layer made of gelatin, and which surface protective layer is preferably the uppermost layer. The composite latex may be contained in any of the above layers. Preferably it is contained in the hydrophillic colloid surface protective layer and more preferably it is contained in a hydrophilic colloid surface protective layer which is the uppermost layer.

Preferred photographic light-sensitive materials of the present invention are as follows:

(i) a silver halide photographic light-sensitive material comprising a support having provided on the same side thereof at least one of silver halide emulsion layers and at least one of surface protective layers, and if necessary, a subbing layer and an interlayer, wherein at least one of these layers contains a composite polymer latex, (ii) a silver halide photographic light-sensitive material comprising a support having provided on the same side thereof the layers described in the above (i) and on the other side side thereof a backing layer, wherein at least one of these layers contains a composite polymer latex, and (iii) a silver halide photographic light-sensitive material comprising a support having provided on the both sides thereof the layers described in the above (i) wherein at least one of the layers contains a composite polymer latex.

In the present invention, it is necessary that both the latex of acrylic acid ester or methacrylic acid ester and colloidal silica are present in the form of an admixture in individual particles, i.e., in the so-called composite form. It is surprising that the improvement of scratch resistance at any humidity can be attained only when the polymer latex and colloidal silica are in the composite form, and that the effect of improving the scratch resistance at any humidity cannot be obtained when the polymer latex and the colloidal silica are separately present in the same protective layer or the same emulsion layer.

As the silver halide of a light-sensitive silver halide emulsion layer to be used in the present invention, silver chloroiodide, silver bromide, silver iodobromide and silver chloroiodobromide can be used. Preferably silver iodobromide is used. The silver iodide content is preferably not more than 30 mol% and particularly preferably not more than 10 mol%. The distribution of iodine in silver iodobromide particles may be uniform, or may be different between the inner portion and the surface. The average particle size is preferably not less than 0.2 μm and particularly preferably is 0.2 to 2.0 μm. The particle size distribution may be narrow or broad.

Silver halide particles contained in the emulsion may have a regular crystal form, such as cubic, octahedral, tetradecahedral and rhombic dodecahedral, or an irregular crystal form, such as spherical, plate-shaped and potato-shaped, or a composite crystal form thereof, or may be a mixture of particles having various crystal forms. Plate-shaped particles in which the particle diameter is at least five times the thickness of the particle are preferably used in the present invention (more specifically, see RESEARCH DISCLOSURE, Vol. 225, Item 22534, pp. 20–58 (1983), U.S. Pat. No. 4,585,729, JP-A-58-113926 (the term "JP-A" as used herein means an "unexamined published Japanese patent application")).

The photographic emulsions to be used in the present invention can be prepared by the methods described, for example, in P. Glafkides, Chimie et Physique Photographique, Paul Montel (1967), G.F. Duffin, Photographic Emulsion Chemistry, The Focal Press (1966), V. L. Zelikman et al., Making and Coating Photographic Emulsion, The Focal Press (1964), U.S. Pat. No. 4,585,729 and JP-A-58-113926. That is, any of the acidic method, the neutral method, the ammonia method, etc., can be employed, and for the reaction of a soluble silver salt and a soluble halogen salt, any of the single jet method, the double jet method, a combination thereof, and so forth can be employed.

A method of forming silver halide particles in the presence of an excess of silver ions (so-called reverse mixing method) can be employed. As one embodiment of the double jet method, there is a method in which the pAg in the liquid phase where silver halide is formed is maintained at a constant level, i.e., a so-called controlled double jet method can be used. The controlled double jet method can provide a silver halide emulsion containing silver halide particles in which the crystal form is regular and the particle size is nearly uniform.

The crystal structure of the silver halide particle may be such that it is uniform throughout, or may be a laminar structure that it is different between the inside and the outside, or may be of the conversion type as described in British Pat. No. 635,841 and U.S. Pat. No. 3,622,318. Silver halide having different compositions may be joined by epitaxial junction, or may be joined to compounds other than silver rhodanide and silver oxide. Furthermore the silver halide may be of the surface latent image type or of the inside latent image type. In the course of formation of silver halide particles or physical ripening in the production of silver halide, in addition to iridium compounds, cadmium salts, zinc salts, lead salts, thallium salts, rhodium salts or its complex salts, iron salts or its complex salts, and the like may be copresent.

At the time of formation of the particles, the particle growth may be controlled by using a silver halide solvent, e.g., ammonia, thioether compounds, thiazolizjne-2-thion, tetra-substituted thiourea, potassium rhodanide, ammonium rhodanide, and amine compounds.

The silver halide emulsion may or may not be chemically sensitized. For chemical sensitization, the sulfur sensitization method, the reduction sensitization method the gold sensitization method and so forth can be used, alone or in combination with each other.

The gold sensitization method is a typical example of the noble metal sensitization method and uses a gold compound, mainly a gold complex salt. The complex salts of noble metal other than gold, e.g., platinum and palladium, may also be used. Specific examples are described in U.S. Pat. No. 2,448,060 and British Pat. No. 618,061.

As the sulfur sensitizer, as well as sulfur compounds contained in gelatin, various sulfur compounds such as thiosulfuric acid salts, thioureas, thiazoles, rhodanines and the like can be used.

As the reduction sensitizer, stannous salts, amines, formaminedisulfinic acid, silane compounds and the like can be used.

In the present invention, as the light-sensitive silver halide emulsion, two or more silver halide emulsions can be used in admixture with each other. Emulsions to be mixed may be different in particle size, halogen composition, sensitivity and so forth. The light-sensitive emulsion may be used in admixture with a substantially light-insensitive emulsion (of which the surface or inside may be fogged or may not be fogged), or they may be used in different layers (specifically, see U.S. Pat. Nos. 2,996,382 and 3,397,987). For example, a light-sensitive emulsion comprising spherical or potato-shaped particles and a light-sensitive silver halide emulsion comprising plate-shaped particles in which the particle diameter is at least five times the thickness of the particle may be used in the same layer or in different layers as described in U.S. Pat. No. 4,585,729. When they are used in different layers, the light-sensitive emulsion comprising plate-shaped particles may be present at the nearer side or the farther side to the support.

To the photographic emulsion to be used in the present invention can be added various compounds as well as the above-described compounds for the purpose of preventing fog in the process of production and during storage of the light-sensitive material, or for stabilizing photographic performance. That is, a number of compounds known as antifoggants or stabilizers, e.g., azoles (e.g., benzothiolium salts, nitroimidazoles, nitrobenzimidazoles, chlorobenzimidazoles, bromobenzimidazoles, nitroindazoles, benzotriazoles and aminotriazoles), mercapto compounds (e.g., mercaptothiazoles, mercaptobenzothiazoles, mercaptobenzimidazoles, mercaptothiadiazoles, mercaptotetraazoles (particularly 1-phenyl-5-mercaptotetraazole), mercaptopyrimidines, mercaptotriazines and the like), thioketo compounds (e.g., oxazolinethione), azaindenes (e.g., triazaindenes, tetraazaindenes (particularly 4-hydroxysubstituted (1,3,3a,7) tetraazaindenes), pentaazaindenes and the like), benzenethiosulfonic acid, benzenesulfinic acid, benzenesulfonic acid amide and the like can be used.

Specific examples are described in RESEARCH DISCLOSURE Item 17643, Clause VI, pp. 24–25 (Dec. 1978) or in the references referred to therein.

Nitron and its derivatives described in U.S. Pat. Nos. 4,555,480 and 4,675,276, mercapto compounds described in JP-A-60-80839, heterocyclic compounds and the complex salt of a heterocyclic compound and silver (e.g., silver 1-phenyl-t-mercaptotetrazole) as described in JP-A-57-164735, and the like are particularly preferably used.

The light-sensitive silver halide emulsion may be spectrally sensitized to blue light having a relatively long wavelength, green light, red light or infrared light by the use of sensitizing dyes. As the sensitizing dye, cyanine dye, merocyanine dye, complex cyanine dye, complex merocyanine dye, holopolar cyanine dye, styryl dye, hemicyanine dye, oxonol dye, hemioxonol dye and the like can be used.

Useful sensitizing dyes which are used in the present invention are described in RESEARCH DISCLOSURE, Item 17643, Clause IV-A, page 23 (Dec. 1978) ibid., Item 18431, Clause X, page 437 (Aug. 1979) or in the references referred to therein.

The sensitizing dye can be added at any step of the process of production of the photographic emulsion, or at any step just before coating after production thereof. Examples of the steps in the process of production are a silver halide particle formation step, a physical ripening step, and a chemical ripening step.

In the photographic emulsion layer and other hydrophilic colloid layer of the light-sensitive material produced by using the present invention, various surfactants may be incorporated for various purposes, for example, as coating aids, or for preventing charging, improving sliding properties, accelerating emulsion and dispersion, preventing adhesion and improving photographic characteristics (e.g., acceleration of development, increasing contrast, and sensitization).

For example, nonionic surfactants, e.g., saponin (steroid-based), alkylene oxide derivatives (e.g., polyethylene glycol, polyethlene glycol/polypropylene glycol condensate, polyethylene glycol alkyl esters or polyethylene glycol alkylaryl esters, polyethylene glycol alkylamines or amides, and silicon polyethylene oxide adducts), glycidol derivatives (e.g., alkenylsuccinic acid polyglyceride and alkylphenol polyglyceride), fatty acid esters of polyhydric alcohols, and alkyl esters of sugar; anionic surfactants containing an acidic group, e.g., a carboxyl group, a sulfo group, a phospho group, a sulfuric acid ester group, and a phosphoric acid ester group, such as alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurins, sulfosuccinic acid esters, sulfoalkyl polyoxyethylene alkylphenyl ethers, and polyoxyethylene alkylphosphoric acid esters; amphoteric surfactants, e.g., amino acids, aminoalkylsulfonic acids, aminoalkylsulfuric acid esters or aminoalkylphosphoric acid esters, alkylbetraines and amine oxides; and cationic surfactants, e.g., alkylamine salts, aliphatic or aromatic quaternary ammonium salts, heterocyclic quaternary ammonium salts (e.g., pyridinium and imidazolium), and aliphatic or heterocyclic ring-containing phosphonium or sulfonium salts can be used. These are described in R. Oda et al., Surfactants and Their Application (Kaimen Kasseizai To Sono Oyo), Maki Shoten (1964), H. Horiguti, New Surfactants (Sin Kaimen Kasseizai), Sankyo Shuppan Co., Ltd., (1975), McCutcheon's Detergents & Emulsifier, McCutchen Divisions, MC Publishing Co., (1985), JP-A-60-76741, JP-A-62-172343, JP-A-62-173459 and JP-A-62-215272.

As the antistatic agent, fluorine-containing surfactants or polymers as described in JP-A-59-74554, JP-A-62-109044 and JP-A-62-215272 and U.S. Pat. No. 4,596,766, nonionic surfactants as described in U.S. Pat. No. 4,649,102, JP-A-60-80846, JP-A-60-80848, JP-A-60-80839, JP-A-60-76741, JP-A-62-17233, JP-A-62-173459, JP-A-62-215272 and U.S. Pat. No. 4,510,233 and electrically conductive polymers or latexes (nonionic, anionic, cationic and amphoteric) as described in JP-A-57-204540 and JP-A-62-215272 are preferably used. As the inorganic antistatic agent, ammonium, and the halogen salts, nitric acid salts, perchloric series acid salts, sulfuric acid salts, acetic acid salts, phosphoric acid salts, and thiocyanic acid salts of alkali metals and alkaline earth metals, and electrically conductive tin oxide, zinc oxide and composite oxides obtained by doping of antimony, etc. in the above metal oxides as described in U.S. Pat. No. 4,394,441 are preferably used. In addition, various electric charge transfer complexes, n-conjugated polymers and their doped materials, organometallic compounds, intralayer compounds, and the like can be used as the antistatic compound. Specific examples are tetracyanoquinodimethane/tetrathiafluvalen (TCNQ/TTF), polyacetylene and polypyrrole. These are described in Science and Industry (Kagaku To Kogyo), 59 (3), 103–111 (1985), and ibid., 59 (4), 146–152 (1985).

In the present invention, as a matting agent, homopolymers, e.g., polymethyl methacrylate, or copolymers of methyl methacrylate and methacrylic acid as described in U.S. Pat. Nos. 2,992,101, 2,701,245, 4,142,894 and 4,396,706, organic compounds such as starch, and fine particles of inorganic compounds such as silica, titanium dioxide, sulfuric acid, strontium and barium can be used. The particle size is preferably 1.0 to 10 μm and particularly preferably 2 to 5 μm.

In the surface layer of the photographic light-sensitive material of the present invention, as a sliding agent the silicone compounds described in U.S. Pat. Nos. 3,489,576 and 4,047,958, and colloidal silica described in JP-B-56-23139 (the term "JP-B" as used therein means an "examined Japanese patent publication"), paraffin wax, higher fatty acid esters, starch derivatives and the like can be used. In particular, polysiloxane and the like are preferably used in the present invention.

In the hydrophilic colloidal layer of the photographic light-sensitive material of the present invention, polyols such as trimethylolpropane, pentanediol, butanediol, ethylene glycol and glycerine can be used as the plasticizer. In the hydrophilic colloidal layer of the photographic light-sensitive material of the present invention, a polymer latex is preferably incorporated for the purpose of improving pressure resistance. As the polymer, homopolymers of acrylic acid alkyl esters, copolymers of acrylic acid alkyl esters and acrylic acid, a styrene-butadiene copolymer, and homo- or co-polymers of monomers containing an active methylene group are preferably used.

The photographic emulsion and the light-insensitive hydrophilic colloid of the present invention may contain an inorganic or organic hardener. For example, chromium salts (e.g., chromium alum), aldehydes (e.g., formaldehyde), N-methylol compounds, dioxane derivatives, active vinyl compounds (e.g., 1,3,5-triacryloyl-hexahydro-s-triazine, bis(vinylsulfonyl)methyl ether, and N,N'-methylenebis-[8-(vinylsulfonyl)-propionamide]), active halogen compounds (e.g., 2,4-dichloro-6-hydroxy-s-triazine), mucohalogenic acids (e.g., mucochloric acid), isooxazoles, dialdehyde starch, 2-chloro-6-hydroxy-triazinylated gelatin, and the like can be used alone or in combination with each other. Of these compounds, active vinyl compounds described in JP-A-53-41220, JP-A-59-162546, and JP-A-60-80846 and U.S. Pat. No. 4,173,481, and active halogenated compounds described in U.S. Pat. No. 3,325,287 are preferably used.

In a case where the light-sensitive material of the present invention is used as an X-ray sensitive material, the hydrophilic colloidal layer is preferably hardened with the hardener in such a manner that the rate of swelling in water as defined by (total film thickness in water/dry film thickness) is not more than 300% and preferably not more than 250%.

As a binder or protective colloid which is to be used in the emulsion layer and the intermediate layer of the light-sensitive material of the present invention, gelatin is advantageously used. In addition, other hydrophilic colloids can be used.

For example, proteins, e.g., gelatin derivatives, graft polymers of gelatin and other polymers, albumin and casein; cellulose derivatives such as hydroxyethyl cellulose, carboxymethylcellulose and cellulose sulfates, sodium alginate, dextran, and starch derivatives; and synthetic hydrophilic polymers, homopolymers or copolymers, such as polyvinyl alcohol, polyvinyl alcohol partial acetal, poly-N-vinylpyrrolidone, polyacrylic acid, polymethacrylic acid, polyacrylamide, polyvinyl imidazole, and polyvinyl pyrazole can be used.

As the gelatin, as well as lime-treated gelatin, acid-treated gelatin and enzyme-treated gelatin may be used. In addition, hydrolyzates of gelatin can be used.

It is preferred that dextran and polyacrylamide be used in combination with gelatin.

The photographic light-sensitive material of the present invention may have, as well as the light-sensitive silver halide emulsion layer, light-insensitive layers such as a surface protective layer, an intermediate layer, and an antihalation layer.

The number of the silver halide emulsion layers may be one, or two or more, and these two or more silver halide emulsion layers may be different in sensitivity, gradation and so forth. On both sides of the support, one, or two or more silver halide emulsion layers and light-insensitive layers may be provided. The number of the surface protective layers may be one, or two or more.

As the support for the general light-sensitive material, a cellulose triacetate film is preferably used. The support may be colored for antihalation, or may not be colored.

As the support for the X-ray photographic light-sensitive material, a polyethylene terephthalate film or a cellulose triacetate film is preferably used. It is particularly preferred that the support be colored in blue.

In order to increase the adhesion between the support and the hydrophilic colloidal layer, the surface of the support is preferably subjected to corona discharging treatment, glow discharging treatment, or ultraviolet ray irradiation treatment, or a subbing layer of a styrene-butadiene-based latex, a vinylidene chloride-based latex and the like may be provided. Furthermore, a gelatin layer may be provided on the top layer. A subbing layer using an organic solvent containing a polyester swelling agent and gelatin may be provided. Application of surface treatment to the subbing layer increases the adhesion force between the subbing layer and the hydrophilic colloidal layer.

The photographic light-sensitive material of the present invention can be used as various types of materials which are to be developed by the usual method. For example, the light-sensitive material of the present invention may be used as an X-ray photographic light-sensitive material, a lith-type photographic light-sensitive material, a black-and-white negative photographic light-sensitive material, a color negative photographic light-sensitive material, a color reversal light-sensitive material, a color paper light-sensitive material or a black-and-white paper light-sensitive material.

In a case where the light-sensitive material of the present invention is used as an X-ray photographic light-sensitive material, it is preferred that stabilizers and antifoggants as described in RESEARCH DISCLOSURE, Item 18431, pp. 433–441 (Aug. 1979), an anti-kink mark agent as described in ibid., pp. 433–436, a protective layer as described in ibid., page 436, Clause IV, cross over controlling techniques as described in ibid., page 436, Clause V, and so forth be used.

In obtaining an X-ray photographic image, light exposure is carried out by the usual method, i.e., a method in which the light-sensitive material is directly irradiated with X-rays, or a light-sensitive material having light-sensitive layers on both sides thereof is sandwiched between two fluorescent sensitized papers or lead foil screen and then irradiated with X-rays.

In the case of a light-sensitive material having a light-sensitive layer on one side thereof, there may be employed a method in which X-rays are applied to the fluorescent sensitized paper and light generated is recorded in the light-sensitive material. As a matter of course, the light-sensitive material and the fluorescent sensitized paper are brought into contact with each other and then irradiated with X-rays. As the phosphor, calcium tungstate, barium sulfate and the like generating blue light, and rare earth phosphors generating green light may be used. After accumulation in the phosphor after exposure to X-rays as described, for example, in U.S. Pat. No. 4,239,968, light exposure is carried out by the use of various light source including infrared light, such as a cathode-ray tube frying spot, emission diode, laser light (e.g., gas laser, YAG laser, dye laser, and semiconductor laser).

Photographic processing of the light-sensitive material of the present invention can be carried out by a known method and using a known processing solution as described in, for example, RESEARCH DISCLOSURE, No. 176, pp. 28–30 (RD-17643)(December 1978). The photographic processing may be a processing forming a silver image (black-and-white photographic processing) or a processing forming a dye image (color photographic processing), depending on the purpose. The processing temperature is usually chosen from the range of 18° to 50° C. Lower temperatures than 18° C. or higher temperatures than 50° C. may be employed.

In the case of black-and-white processing, the developer to be used can contain a known developing agent. As the developing agent, dihydroxybenzenes (e.g., hydroquinone), 3-pyrazolidones (e.g., 1-phenyl-3-pyrazolidone), aminophenols (e.g., N-methyl-p-aminophenol) and the like can be used alone or in combination with each other. In the photographic processing of the light-sensitive material of the present invention, a developer containing imidazoles as the silver halide solvent as described in JP-A-57-78535 can be used. In addition, a developer containing a silver halide solvent and additives such as imidazole or traizole can be used. In general, the developer further contains other known additives such as a preservative, an alkali agent, a pH buffer, and an antifoggant, and if necessary, may contain a dissolution aid, a color controlling agent, a development accelerator, a surfactant, a defoaming agent, a hard water-softening agent, a hardener (e.g., glutaraldehyde), a viscosity imparting agent and the like.

As the fixer, those having the compositions conventionally used can be used. As the fixing agent, as well as thiosulfuric acid salts and thiocyanic acid salts, organosulfuric compounds which are known to be effective as the fixing agent can be used. The fixer may contain water-soluble aluminum salts as the hardener.

The present invention is described in greater detail with reference to the following examples although it is not intended to be limited thereto.

EXAMPLE 1

Preparation of Emulsion 1

Emulsion 1 was an emulsion of tetradecahedral AgBrI (I=1.0 mol%) having a diameter (calculated as a sphere) of 0.8 μm. Emulsion 1 was formed by first preparing a solution containing 2 g/1 of 3,6-dithia-1,8octanediol as a silver halide solvent, 1.2 g of KBr and 28 g of gelatin in 1 liter of water, and then adding 1.41 mol of $AgNO_3$, 1.41 mol of KBr and 0.014 mol of KI under conditions of 75° C. and pBr=2.0 by double jetting for 55 minutes. Precipitation and rinsing with water were repeated three times, and then water and gelatin were added to obtain 1.440 g of an emulsion. To this emulsion, 0.1 g of 1-phenyl-5-mercaptotetrazole, 10 mg of sodium thiosulfate and 7 mg of chloroauric acid were added, and they were aged at 55° C. Then, 1.4 g of 4-hydroxy-6-methyl-1,3,3a,7-tetraazaindene was added to obtain the desired Emulsion 1.

Preparation of Emulsion 2

Emulsion 2 was an emulsion containing particles having an aspect ratio (particle diameter as a spere/-thickness of particle) of 10.0, an iodine content of 12 mol% and a particle diameter (calculated as a sphere) of 0.43 μm as prepared by the method described in U.S. Pat. No. 4,425,425.

These Emulsions 1 and 2 were coated on a polyethylene terephthalate support coated with a subbing layer, along with sodium 3-(5-mercaptotetrazolyl)-benzenesulfonate as an antifoggant and a coating aid in such a manner that the amount of silver coated was 6 g/m$^2$. As a protective layer, a gelatin solution containing bistype polyethylene oxide, a carbon fluoride-based surfactant and an anionic surfactant as coating aids, a matting agent comprising polymethyl methacrylate, a polysiloxane-based sliding agent, a hardener comprising 2,4-dichloro-6-hydroxy-s-triazine, and a composite polymer latex of the present invention (VONCOAT DV series, produced by Dai-Nippon Ink Co., Ltd.) or colloidal silica or a polymer latex of ethyl methacrylate was coated.

Samples 1 to 21 were prepared in the same manner as above except that the type of the emulsion, the thickness of the protective layer, the type of the composite latex, the amount of the composite latex, the amount of the ethyl methacrylate latex, and the amount of the colloidal silica were changed as shown in Table 1.

TABLE 1

| Sample No. | Type of Emulsion | Thickness of Protective layer (μm) | Composite Latex Type | Composite Latex Amount (solid) (g/m$^2$) | Amount of Ethyl Methacrylate (solid) Polymer Latex (g/m$^2$) | Amount of Colloidal Silica (solid) (g/m$^2$) |
|---|---|---|---|---|---|---|
| 1 | 1 | 1.2 | none | | none | none |
| 2 | " | 1.5 | " | | " | " |
| 3 | " | 1.8 | " | | " | " |
| 4 | " | 1.2 | " | | 0.3 | " |
| 5 | " | " | " | | 1.0 | " |
| 6 | " | " | " | | none | 0.1 |
| 7 | " | " | " | | " | 0.5 |
| 8 | " | " | " | | 0.3 | 0.1 |
| 9 | " | " | " | | " | 0.5 |

TABLE 1-continued

| Sample No. | Type of Emulsion | Thickness of Protective layer (μm) | Composite Latex Type | Composite Latex Amount (solid) (g/m²) | Amount of Ethyl Methacrylate (solid) Polymer Latex (g/m²) | Amount of Colloidal Silica (solid) (g/m²) |
|---|---|---|---|---|---|---|
| 10 | " | " | " | | 1.0 | 0.1 |
| 11 | " | " | " | | " | 0.5 |
| 12 | " | " | DV-759 | 0.1 | none | none |
| 13 | " | " | " | 0.3 | " | " |
| 14 | " | " | " | 1.0 | " | " |
| 15 | " | " | " | 3.0 | " | " |
| 16 | 1 | 1.2 | "DV-857 | 0.3 | none | none |
| 17 | " | " | DV-803 | " | " | " |
| 18 | 2 | " | none | | 0.3 | — |
| 19 | " | " | " | | — | 0.1 |
| 20 | " | " | " | | 0.3 | " |
| 21 | " | " | DV-759 | 0.3 | none | none |

Note:
DV-579 contains 30 wt % of colloidal silica based on the weight of buthyl acrylate and has a particle size of about 0.3 μm in a diameter.
DV-857 contains 50 wt % of colloidal silica based on the weight of buthyl acrylate and has a particle size of about 0.3 μm in a diameter.
DV-803 contains 200 wt % of colloidal silica based on the weight of buthyl acrylate and has a particle size of about 0.3 μm in a diameter.

The samples shown in Table 1 were evaluated by the following methods.

(1) Relative Speed

The sample was placed in a cassette sandwiched between lead foil screen and different areas were irradiated with X-rays for times of 1 second, 1.6 seconds, 2.5 seconds, . . . . 250 seconds (Thus, each succesive exposure was made longer by $10^{0.2}$ times).

The samples were subjected to the following automatic developing machine treatment.

(a) Automatic Developing Machine;

Fuji Industrial X-Ray Processor (trade name: Super IX-17 manufactured by Fuji Photo Film Co., Ltd.).

(b) Processing Solution and Processing Temperature;

| (Processing Step) | (Processing Solution) | (Processing Temperature) |
|---|---|---|
| Development | Super Dole I* | 23° C. |
| Fixation | Super FI* | 30° C. |
| Rinsing | Flowing water | 31° C. |
| Drying | — | about 45° C. |

*Both were produced by Fuji Photo Film Co., Ltd.

The sample was measured for optical density, and based on the optical density, the relation of log (X-ray irradiation time) to optical density was obtained. The X-ray irradiation time at the point that the optical density was Fog+2.0 was determined. The reciprocal of the irradiation time was made an index of sensitivity, and from the value of the index, the relative sensitivity was determined.

(2) Scratch Resistance Test

Each sample was sandwiched between an X-ray photographic fluorescent screen and a lead foil screen under conditions of 25° C. and 90%RH, and the sensitized paper and the film were placed in intimate contacted by applying a load of 20 g/m². After one minute, the sample was withdrawn between the screen and the film at a speed of 2 m/sec. The film was developed in the same manner as in (1), and the formation of blackened scratches was examined.

The rating was as follows:

A: Not formed
B: Less formed
C: Somewhat formed
D: Formed
E: Considerably formed The formation of blackened scratches was examined in the same manner as above except that the test conditions were changed to 25° C., 75%; 25° C., 60%; 25° C., 40%; 25° C., 25%; or 25° C., 10%.

The results are shown in Table 2.

TABLE 2

| Sample No. | Relative Speed | Scratch Resistance 25° C., 90% RH | 25° C., 75% RH | 25° C., 60% RH | 25° C., 40% RH | 25° C., 25% RH | 25° C., 10% RH |
|---|---|---|---|---|---|---|---|
| 1 | 100 | D | D | D | D | D | D |
| 2 | 90 | C | C | C | C | C | C |
| 3 | 75 | B | B | B | B | B | B |
| 4 | 100 | D to E | D | D | C | C | C |
| 5 | " | E | D to E | D | B | B | B |
| 6 | " | C | C | D | D | D | D |
| 7 | " | B | C to B | D | D | D | D |
| 8 | " | D to E | D | D | C | C | C |
| 9 | " | D to E | D | D | C | C | C |
| 10 | " | E | D to E | D | B | B | B |
| 11 | " | E | D to E | D | B | B | B |
| 12 | " | B | B | B | B | B | B (This Invention) |
| 13 | " | A | A | A | A | A | A ( This Invention) |
| 14 | " | A | A | A | A | A | A (This Invention) |

TABLE 2-continued

| Sample No. | Relative Speed | Scratch Resistance 25° C., 90% RH | 25° C., 75% RH | 25° C., 60% RH | 25° C., 40% RH | 25° C., 25% RH | 25° C., 10% RH |
|---|---|---|---|---|---|---|---|
| 15 | " | A | A | A | A | A | A (This Invention) |
| 16 | " | B | B | B | B | B | B (This Invention) |
| 17 | " | A | A | A | A | A | A (This Invention) |
| 18 | 70 | E | D to E | D | B | B | B |
| 19 | " | B | C to B | D | D | D | D |
| 20 | " | E | D to E | D | B | B | B |
| 21 | " | A | A | A | A | A | A (This Invention) |

As can be seen from Table 2, as the thickness of the protective layer is increased, the scratch resistance is improved, but the sensitivity is decreased.

If the protective layer contains a methacrylic acid ester latex, the scratch resistance is improved at a low humidity region, but at a high humidity region, it is rather reduced.

If the colloidal silica is contained in the protective layer, the scratch resistance is improved at a high humidity region, but not at a low humidity region. Even in a sample containing a polymer latex and colloidal silica in the protective layer, an improvement in scratch resistance over the all humidity regions was not observed.

In a sample containing a composite latex of methacrylic acid ester and colloidal silica of the present invention in the protective layer, the scratch resistance is improved at any humidity region (10 to 90%RH).

EXAMPLE 2

Samples 22 to 28 were prepared in the same procedure as in Example 1 except for adding VONCOAT DV-759, ethyl methacrylate and a colloidal sillica into each emulsion layer of Emulsion 1 and Emulsion 2 prepared in Example 1.

The scratch resistance of the samples obtained was evaluated in the same manner as in Example 1.

The results are shown in Table 3.

Table 3

| Sample No. | Type of Emulsion | Thickness of Protective Layer μm | Amount of DV-759 (solid) g/m² | Amount of Ethyl Methacrylate Polymer latex (solid) g/m² | Amount of colloidal silica (solid) g/m² | Relative speed | Scratch Resistance 25° C. 90% RH | 25° C. 75% RH | 25° C. 60% RH | 25° C. 40% RH | 25° C. 25% RH | 25° C. 10% RH |
|---|---|---|---|---|---|---|---|---|---|---|---|---|
| 1 | 1 | 1.2 | — | — | — | 100 | D | D | D | D | D | D |
| 22 | 1 | 1.2 | — | — | 0.2 | 100 | C-D | C-D | D | D | D | D |
| 23 | 1 | 1.2 | — | 0.4 | 0.2 | 100 | D | D | D | D | D | D |
| 24 | 1 | 1.2 | 0.4 | — | — | 100 | B | B | B | B | B | B |
| 25 | 2 | 1.2 | — | — | — | 70 | D | D | D | D | D | D |
| 26 | 2 | 1.2 | — | — | 0.2 | 70 | C-D | C-D | D | D | D | D |
| 27 | 2 | 1.2 | — | 0.4 | 0.2 | 70 | D | D | D | D | D | D |
| 28 | 2 | 1.2 | 0.4 | — | — | 70 | B | B | B | B | B | B |

Note: Samples 24 and 28 are of this invention

As can be seen from Table 3, even if a composite polymer latex according to the present invention is incorporated into the emulsion layer, the scratch resistance is improved at any humidity (10 to 90%RH) without decreasing the relative speed or the contrast.

The invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon at least two hydrophilic colloid layers, wherein at least one of said layers is a photosensitive silver halide emulsion layer, and at least one of said layers contains a composite polymer latex comprising polymeric acrylic acid ester and/or polymeric methacrylic acid ester and colloidal silica.

2. A silver halide photographic light sensitive material as in claim 1, wherein the colloidal silica is present in the composite latex in an amount of 5 to 400% by weight based on the amount by weight of polymeric acrylic acid ester and/or polymeric methacrylic acid in the composite latex.

3. A silver halide photographic light-sensitive material as in claim 1, wherein said composite latex is provided in an amount of from 0.03 to 10 gram per square meter of photographic material.

4. A silver halide photographic light-sensitive material as in claim 1, wherein said composite latex is provided in a layer which is further from the support than the silver halide emulsion layer.

5. A silver halide photographic light-sensitive material as in claim 4, wherein said layer containing the composite latex is the layer furthest from the support.

6. A silver halide photographic light-sensitive material as in claim 1, wherein said composite latex is comprised of particles having a particle diameter of from 0.01 to 0.5 μm.

7. A silver halide photographic light-sensitive material as in claim 1, wherein said composite latex is comprised of particles having a particle diameter of from 0.02 to 0.3 μm.

8. A silver halide photographic light-sensitive material as in claim 1, wherein said polymeric acrylic acid ester or polymeric methacrylic acid ester is prepared from a monomer selected from the group consisting of methyl acrylate, ethyl acrylate, butyl acrylate, methyl methacrylate, ethyl methacrylate, and propyl methacrylate, or mixtures thereof.

* * * * *